US008340538B2

(12) United States Patent
Jeong

(10) Patent No.: US 8,340,538 B2
(45) Date of Patent: Dec. 25, 2012

(54) METHOD AND APPARATUS TO CONTROL ELECTRONIC POWER OF COIL WHICH PERFORMS INDUCTION HEATING IN IMAGING APPARATUS

(75) Inventor: An-sik Jeong, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 508 days.

(21) Appl. No.: 12/656,533

(22) Filed: Feb. 2, 2010

(65) Prior Publication Data

US 2011/0013918 A1 Jan. 20, 2011

(30) Foreign Application Priority Data

Jul. 20, 2009 (KR) ..... 10-2009-0065888

(51) Int. Cl.
*G03G 15/00* (2006.01)

(52) U.S. Cl. ..... 399/37; 219/660

(58) Field of Classification Search ..... 399/37; 219/660, 661, 663, 664
See application file for complete search history.

*Primary Examiner* — Walter L Lindsay, Jr.
*Assistant Examiner* — Ruth Labombard
(74) *Attorney, Agent, or Firm* — Staas & Halsey LLP

(57) ABSTRACT

Provided is a method of controlling electric power of a coil which performs induction heating in an imaging apparatus. The method includes: detecting an input current of the coil; detecting a resonant current of the coil; calculating a difference between the detected resonant current and the detected input current; and controlling electric power supplied to the coil based on the difference. These operations are repeatedly performed whenever the detected input current is changed.

18 Claims, 3 Drawing Sheets

METHOD AND APPARATUS TO CONTROL ELECTRONIC POWER OF COIL WHICH PERFORMS INDUCTION HEATING IN IMAGING APPARATUS

CROSS-REFERENCE TO RELATED APPLICATIONS

This application claims the benefit of Korean Patent Application No. 10-2009-0065888, filed on Jul. 20, 2009, in the Korean Intellectual Property Office, the disclosure of which is incorporated herein in its entirety by reference.

BACKGROUND

1. Field

The embodiment relates to a method and apparatus to control electric power of a coil which performs induction heating in an imaging apparatus.

2. Description of the Related Art

In general, electrophotographic imaging apparatuses, such as laser printers, facsimile machines, or copiers, form an image in the following manner. An electrical latent image formed on a photoconductive drum is developed with toner into a visible toner image, the visible toner image is transferred onto a printing medium supplied from a paper supply cassette, and the transferred toner image is fixed on the printing medium. In such electrophotographic imaging apparatuses, in most cases, the transferred toner image is fixed by simultaneously applying heat and pressure on the printing medium. Thus, a fixing apparatus to fix the toner image to the printing medium necessarily includes a heating unit to apply heat to the printing medium and a pressing unit to apply a predetermined pressure to the printing medium while in contact with the heating unit. In this case, the heating unit is operated in a lamp-heating manner in which radiation heat of a halogen lamp is used or an induction-heating manner in which heat resistance of an induction coil is used. Between the two, the induction-heating manner is used more often due to its high efficiency. Meanwhile, in order to drive a heating unit in the induction-heating manner, electric power is provided to the heating unit, which includes a coil. However, when power voltage to the coil is too high, damage may result to the heating unit, an inverter to drive the heating unit, inner devices of the imaging apparatus, and an imaging system.

SUMMARY

Accordingly, it is an aspect to provide a method and apparatus to control electric power provided to a coil which performs induction heating in an imaging apparatus.

It is another aspect to reduce the likelihood of damage resulting from excessive voltage supplied to the coil.

Additional aspects and/or advantages will be set forth in part in the description which follows and, in part, will be apparent from the description, or may be learned by practice.

The foregoing and/or other aspects are achieved by providing a method of controlling electric power supplied to a coil which performs induction heating in an imaging apparatus, wherein the method includes: detecting an input current of the coil; detecting a resonant current of the coil; calculating a difference between the detected resonant current and the detected input current; and controlling the electric power supplied to the coil based on the calculated difference.

The foregoing and/or other aspects are also achieved by providing a computer-readable recording medium on which a program to perform the method of controlling electric power of a coil which performs induction heating in an imaging apparatus in a computer is recorded.

The foregoing and/or other aspects are also achieved by providing a control apparatus to control electric power supplied to a coil which performs induction heating in an imaging apparatus, wherein the apparatus includes: an input current detection unit that detects an input current of the coil; a resonant current detection unit that detects a resonant current of the coil; a computing unit that calculates a difference between the detected resonant current t and detected input current; and an electric power control unit that controls the electric power supplied to the coil based on the calculated difference.

BRIEF DESCRIPTION OF THE DRAWINGS

The above and other features and advantages will become more apparent by describing in detail exemplary embodiments thereof with reference to the attached drawings in which.

DETAILED DESCRIPTION OF EMBODIMENTS

Figure 1A:
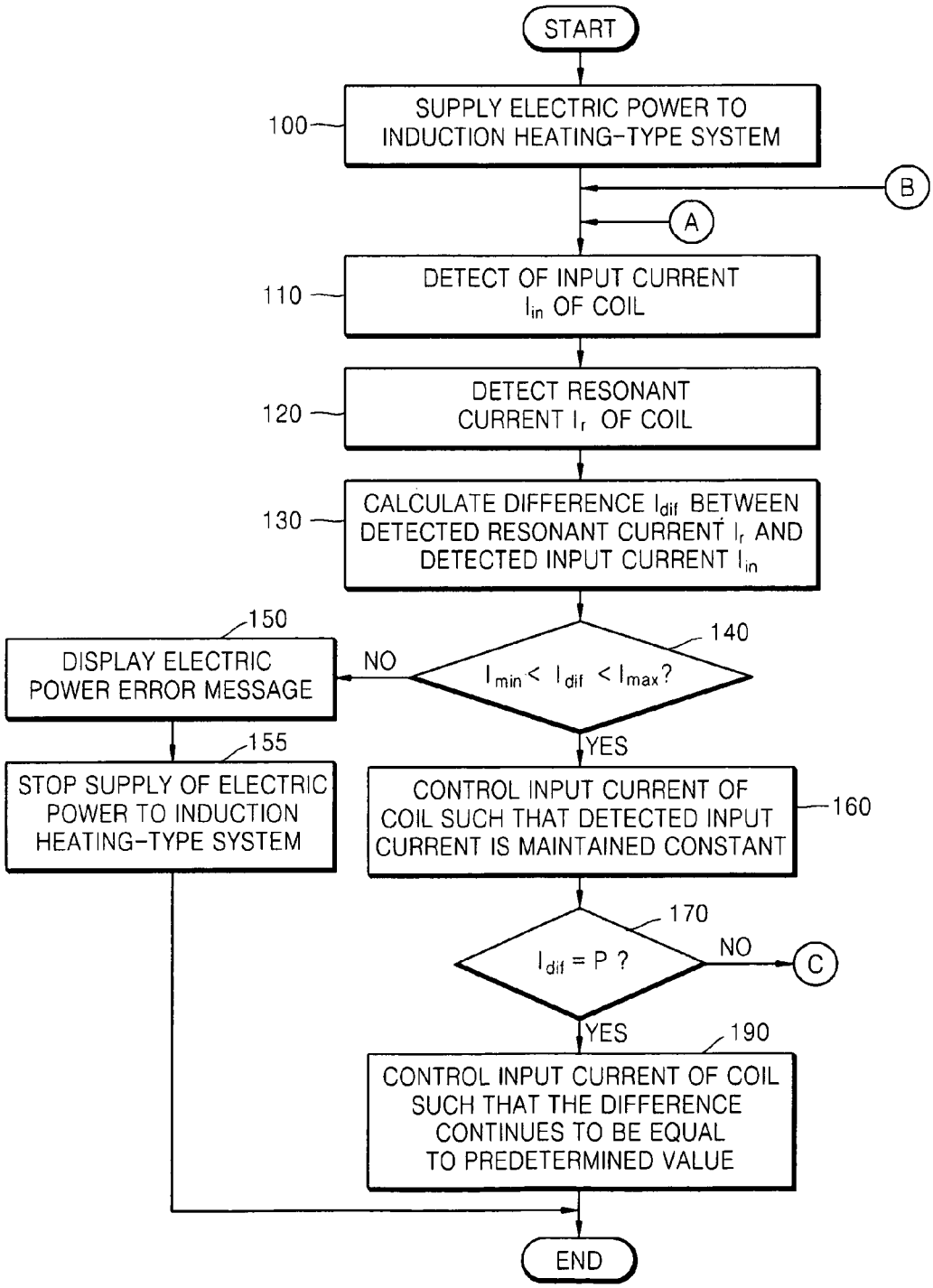
FIGS. 1A and 1B illustrate a flowchart illustrating a method of controlling electric power of a coil which performs induction heating in an imaging apparatus according to an embodiment.

Reference will now be made in detail to the embodiments, examples of which are illustrated in the accompanying drawings, wherein like reference numerals refer to the like elements throughout. The embodiments are described below by referring to the figures.

Figure 1B:
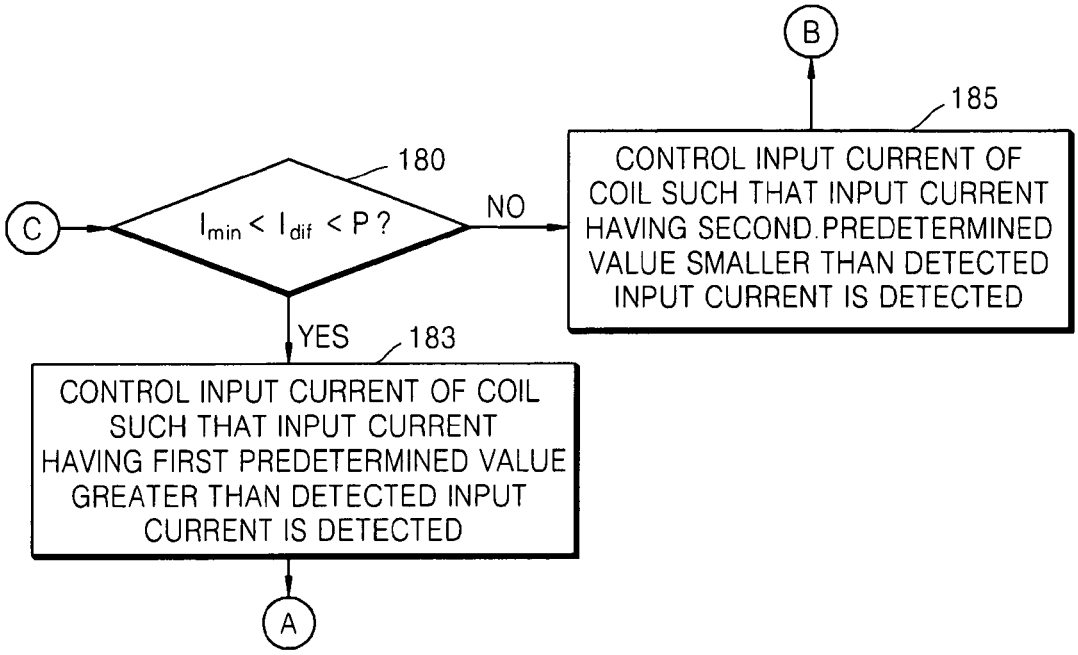

FIGS. 1A and 1B illustrate a flowchart illustrating a method of controlling electric power of a coil which performs induction heating in an imaging apparatus, according to an embodiment.

In operation 100, electric power is supplied to an induction heating-type system. When an alternating electric power is provided to an inverter to drive a coil which performs induction heating, the inverter is driven and accordingly, the induction heating-type system operates, and a current flows in inner devices of the induction heating-type system.

In operation 110, an input current $I_{in}$ of the coil is detected. For example, the $I_{in}$ may be detected by using a current transformer (CT).

In operation 120, a resonant current $I_r$ of the coil is detected. The resonant current $I_r$, which is generated when a current flows in the coil in the induction heating-type system and a circuit including a capacitor, may be detected by using a CT. The resonant current $I_r$ is generally proportional to the input voltage supplied to the coil. Thus, the input voltage may be predicted from the detected resonant current $I_r$.

In operation 130, a difference $I_{dif}$ between the detected resonant current $I_r$ and the detected input current $I_{in}$ is calculated. The detected input current $I_{in}$ is subtracted from the detected resonant current $I_r$ to obtain the difference ($I_{dif}=|I_r-I_{in}|$). Since the absolute value of the difference $I_{dif}$ is acquired, the difference $I_{dif}$ is a positive value.

In operation 140, it is determined whether the difference $I_{dif}$ is within a predetermined value. According to an embodiment, a minimum value $I_{min}$ and a maximum value $I_{max}$ of $I_{dif}$ to normally operate the induction heating-type system may be predetermined. In this regard, the predetermined minimum value $I_{min}$ and maximum value $I_{max}$ may be changed according to characteristics of the induction heating-type system. Thus, whether the difference $I_{dif}$ is within the predetermined range (between $I_{min}$ and $I_{max}$) is determined by identifying whether the difference $I_{dif}$ is between the predetermined minimum value $I_{min}$ and maximum value $I_{max}$. If the difference $I_{dif}$ is within the predetermined range, operation 160 is performed; otherwise, operation 150 is performed.

In operation 150, an electric power error message is displayed. If the difference $I_{dif}$ is outside the predetermined range, this means an electric power to normally operate the induction heating-type system is not being provided. Thus, the electric power error message is displayed so that a user recognizes that the difference $I_{dif}$ is outside the predetermined range.

In operation 155, the supply of the electric power to the induction heating-type system is stopped to stop the driving of the inverter to drive the coil that performs induction heating.

In operation 160, the input current of the coil is controlled such that the detected input current $I_{in}$ is maintained constant. If the difference $I_{dif}$ is within the predetermined range, this means an electric power to normally operate the induction heating-type system is being provided. Thus, the electric power input to the induction heating-type system is controlled such that the detected input current $I_{in}$, is constant.

In operation 170, it is determined whether the difference $I_{dif}$ is equal to a predetermined value P. The predetermined value P is a reference value to evaluate an electric power supplied to stably operate a system, and is a value between the predetermined minimum value $I_{min}$ and the maximum value $I_{max}$. In addition, the predetermined value P may vary according to characteristics of the system. P is obtained by measurement before operation of the embodiments. If the difference $I_{dif}$ is equal to the predetermined value P, this means the induction heating-type system is normally operating according to the supply of the input electric power without an abnormal voltage change. If the difference $I_{dif}$ is equal to the predetermined value P, operation 190 is performed; otherwise, operation 180 is performed.

In operation 180, it is determined that the difference $I_{dif}$ is between the minimum value $I_{min}$ of the predetermined range and the predetermined value P. That is, it is identified that the difference $I_{dif}$ is greater than the predetermined minimum value $I_{min}$ and less than the predetermined value P. Recall that the detected resonant current $I_r$ is proportional to the input voltage. Thus, the difference $I_{dif}$ is also proportional to the input voltage. In addition, when the difference $I_{dif}$ is between the minimum value $I_{min}$ of the predetermined range and the predetermined value P, an input voltage is smaller than a reference voltage and the supplied electric power is relatively small.

In operation 183, the input current of the coil is controlled such that an input current $I(\mathbf{1})_{in}$ that is a first predetermined value P(1) greater than the detected input current $I_{in}$ is detected. The electric power supplied to the coil is controlled such that the input current $I(\mathbf{1})_{in}=I_{in}+P(\mathbf{1})$ that is the first predetermined value P(1) greater than the detected input current $I_{in}$, is detected. In addition, the control of the electric power is performed to detect the changed input current $I(\mathbf{1})_{in}$ and then, operation 110 is performed.

In operation 185, the input current of the coil is controlled such that an input current $I(\mathbf{2})_{in}$ that is a second predetermined value P(2) smaller than the detected input current $I_{in}$ is detected. The electric power supplied to the coil is controlled such that the input current $I(\mathbf{2})_{in}=I_{in}-P(\mathbf{2})$ having the second predetermined value (P(2)) smaller than the detected input current $I_{in}$ is detected. In addition, the control of the electric power is performed to detect the changed input current $I(\mathbf{2})_{in}$ and then, operation 110 is performed.

In operation 190, the electric power supplied to the coil is controlled such that the difference $I_{dif}$ continues to be identical to the predetermined value P. The electric power supplied to the coil may be controlled by adjusting the current flowing in the coil. The electric power supplied to the coil may be controlled such that the difference $I_{dif}$ continues to be equal to the predetermined value P by adjusting on and off periods of switching devices to control the current flowing in the coil. As described above, by using the method of controlling electric power supplied to the coil which performs induction heating, electric power of a system is stably controlled without detection of an input voltage.

Figure 2:
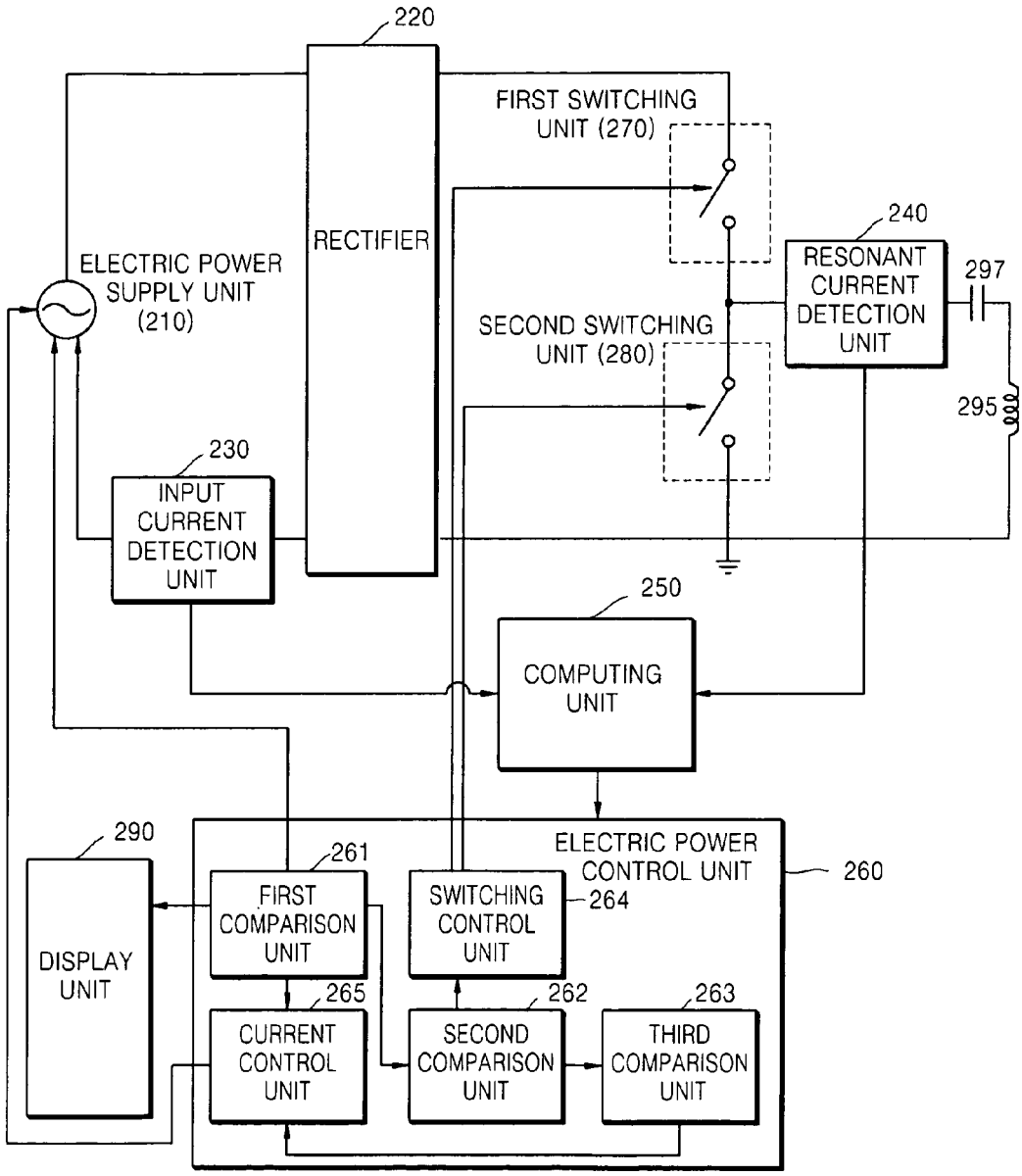
FIG. 2 is a block diagram illustrating an apparatus to control electric power of a coil which performs induction heating in an imaging apparatus, according to the embodiment.

FIG. 2 is a block diagram illustrating an apparatus to control electric power of a coil which performs induction heating in an imaging apparatus. Referring to FIG. 2, the apparatus includes an electric power supply unit 210, a rectifier 220, an input current detection unit 230, a resonant current detection unit 240, a computing unit 250, an electric power control unit 260, a first switching unit 270, a second switching unit 280, and a display unit 290.

The electric power supply unit 210 is a unit to supply an alternating electric power to an induction heating-type system, and an alternating current, which is output to the induction heating-type system by the electric power supply unit 210, is rectified into a direct current by the rectifier 220. The direct current is provided to a coil 295, which performs induction heating.

The input current detection unit 230 detects an input current of the coil 295. The input current detection unit 230 is connected to the electric power supply unit 210 in series, and detects the intensity of the input current flowing in the induction heating-type system. For example, a CT may be used as the input current detection unit 230 to detect the input current. The input current detection unit 230 outputs the detected input current to the computing unit 250.

The resonant current detection unit 240 detects the resonant current of the coil 295. In the induction heating-type system, the coil 295, which performs induction heating, and a capacitor 297 are connected in series, and when the current flows in a circuit including the coil 295 and the capacitor 297, a resonance phenomenon may occur. The coil 295 may be located inside a fixing apparatus of the imaging apparatus to perform as a heating device in the fixing apparatus. For example, a CT may be used as the resonant current detecting unit 240 to detect the resonant current. The resonance current may be proportional to the input voltage supplied to the coil. Thus, the input voltage may be predicted from the detected resonant current. The resonant current detection unit 240 may output the detected resonant current to the computing unit 250.

The computing unit 250 calculates a difference between the resonant current $I_r$ that is input by the resonant current detection unit 240 and the input current $I_{in}$ that is input by the input current detection unit 230. The computing unit 250 subtracts the detected input current $I_{in}$ from the detected resonant current $I_r$ to obtain the difference $I_{dif}(I_{dif}|I_r-I_{in}|)$. Since the computing unit 250 acquires the absolute value of the difference $I_{dif}$, the difference $I_{dif}$ is a positive value. The computing unit 250 outputs the difference $I_{dif}$ to the electric power control unit 260.

The electric power control unit 260 controls an electric force supplied to the coil 295 by referring to the difference $I_{dif}$ obtained by the computing unit 250. The electric power control unit 260 may include a first comparison unit 261, a second comparison unit 262, a third comparison unit 263, a switching control unit 264, and a current control unit 265.

The first comparison unit 261 identifies whether the difference $I_{dif}$ obtained by the computing unit 250 is within a predetermined range. The range of the difference between the resonant current $I_r$ and the input current $I_{in}$ to normally operate the induction heating-type system may be predetermined. The range may include a minimum value $I_{min}$ and a maximum value $I_{max}$. The first comparison unit 261 identifies whether the difference $I_{dif}$ has a value between the minimum value $I_{min}$ and the maximum value $I_{max}$. If the difference $I_{dif}$ is within the predetermined range, result signals are output to the second comparison unit 262 and the current control unit 265. On the other hand, if the difference $I_{dif}$ is outside the predetermined range, result signals are output to the display unit 290, and an electric power supply stop signal is output to the electric power supply unit 210 so that the supply of the electric power to the induction heating-type system is stopped.

The second comparison unit 262 receives the result signals from the first comparison unit 261, and identifies whether the calculated difference $I_{dif}$ is equal to a predetermined value P. The predetermined value P is a reference value to determine an electric force supplied to the induction heating-type system in order to stably operate the induction heating-type system, and may be between the predetermined minimum value $I_{min}$ and the maximum value $I_{max}$. If the difference $I_{dif}$ is equal to the predetermined value P, result signals are output to the switching control unit 264. On the other hand, if the difference $I_{dif}$ is different from the predetermined value P, result signals are output to the third comparison unit 263.

The third comparison unit 263 receives the result signals from the second comparison unit 262, and identifies whether the difference $I_{dif}$ has a value between the minimum value $I_{min}$ and the predetermined value P and outputs result signals to the current control unit 265.

The switching control unit 264 receives the result signals from the second comparison unit 262, and outputs a control signal to control the current flowing in the coil 295 to the first switching unit 270 and the second switching unit 280. The first switching unit 270 and the second switching unit 280 may operate such that the supplied electric power continues to be a predetermined value P by adjusting on and off periods according to the input control signal.

The current control unit 265 receives result signals from the first comparison unit 261 and outputs a control signal to the electric power supply unit 210, so that the input current of the coil 295 is controlled such that the input current initially detected by the input current detection unit 230 is maintained constant. When the current control unit 265 receives from the third comparison unit 263 a result signal indicating that the difference $I_{dif}$ is included between the minimum value $I_{min}$ and the predetermined value P, the current control unit 265 outputs an increase signal to the electric power supply unit 210 so that the input current of the coil 295 is controlled such that the input current detection unit 230 detects an input current that is a first predetermined value P1 greater than the initially detected input current. On the other hand, if the current control unit 265 receives from the third comparison unit 263 an outcome signal indicating that the difference $I_{dif}$ has a value between the maximum value $I_{max}$ and the predetermined value P of the predetermined range, the current control unit 265 outputs a decrease signal to the electric power supply unit 210 so that the input current of the coil 295 is controlled such that the input current detection unit 230 detects an input current the first predetermined value P1 smaller than the initially detected input current.

The display unit 290 displays an electric power error message. Thus, a user may recognize an occurrence of an error voltage in the system.

The embodiments can be implemented in computing hardware (computing apparatus) and/or software, such as (in a non-limiting example) any computer that can store, retrieve, process and/or output data and/or communicate with other computers. The results produced can be displayed on a display of the computing hardware. A program/software implementing the embodiments may be recorded on computer-readable media comprising computer-readable recording media. The program/software implementing the embodiments may also be transmitted over transmission communication media. Examples of the computer-readable recording media include a magnetic recording apparatus, an optical disk, a magneto-optical disk, and/or a semiconductor memory (for example, RAM, ROM, etc.). Examples of the magnetic recording apparatus include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of controlling electric power supplied to a coil which performs induction heating in an imaging apparatus, the method comprising:

detecting an input current of the coil;

detecting a resonant current of the coil;

calculating a difference between the detected resonant current and the detected input current; and controlling the electric power supplied to the coil based on the calculated difference.

2. The method of claim 1, wherein the controlling of the electric power supplied to the coil comprises:

determining whether the calculated difference is within a predetermined range;

determining whether the calculated difference is equal to a predetermined value, if the calculated difference is within the predetermined range; and maintaining the difference at the predetermined value, comprising controlling the electric power supplied to the coil, if determined that the difference is equal to the predetermined value.

3. The method of claim 2, further comprising maintaining the input current comprising controlling the input current, if determined that the difference is within the predetermined range.

4. The method of claim 2, further comprising:

identifying whether the calculated difference is between a minimum value and the predetermined value, if determined that the difference is not equal to the predetermined value; and increasing the input current of the coil, if the difference is between the minimum value and the predetermined value.

5. The method of claim 4, further comprising:

decreasing the input current of the coil, if the difference is not between the minimum value and the predetermined value.

6. The method of claim 1, further comprising:

displaying an electric power error message, if determined that the difference is not within the predetermined range.

7. The method of claim 6, further comprising stopping the supply of the electric power to the coil if determined that the differences is not within the predetermined range.

8. The method of claim 1, wherein the imaging apparatus comprises a fixing apparatus and the coil is located in the fixing apparatus.

9. A computer-readable recording medium on which a program for performing the method of claim 1 in a computer is recorded.

10. The method of claim 1, further comprising:

determining whether the input current has changed; and repeating the detecting the resonant current, calculating the difference, and controlling the supplied electric power, if determined that the input current has changed.

11. A control apparatus to control electric power supplied to a coil which performs induction heating in an imaging apparatus, the control apparatus comprising:

an input current detection unit that detects an input current of the coil;

a resonant current detection unit that detects a resonant current of the coil;

a computing unit that calculates a difference between the detected resonant current and the detected input current; and an electric power control unit that controls the electric power supplied to the coil based on the calculated difference.

12. The control apparatus of claim 11, wherein the electric power control unit comprises:

a first comparison unit that determines whether the calculated difference is within a predetermined range;

a second comparison unit that determines whether the calculated difference is equal to a predetermined value of the predetermined range, if the difference calculated is within the predetermined range; and a switching control unit that controls on and off periods of a switch supplying electric power to the coil, if the calculated difference is equal to the predetermined value, so that the difference continues to be equal to the predetermined value.

13. The apparatus of claim 12, wherein the electric power control unit further comprises a current control unit that controls the input current of the coil if the difference is within the predetermined range such that the input current is constant.

14. The apparatus of claim 13, wherein the electric power control unit further comprises a third comparison unit that identifies whether the difference is between a minimum value and a predetermined value, if the difference is not equal to the predetermined value, and the current control unit controls the input current of the coil such that the input current is a predetermined value greater than the detected input current, if the difference is between the minimum value and the predetermined value.

15. The apparatus of claim 14, wherein the current control unit controls the input current of the coil such that the input current is a predetermined value smaller than the detected input current, if the difference is not between the minimum value and the predetermined value.

16. The apparatus of claim 12, further comprising a display unit that displays an electric power error message if the difference is not within the predetermined range, wherein the electric power control unit stops supply of the electric power to the coil if the difference is not within the predetermined range.

17. The apparatus of claim 11, wherein the imaging apparatus further comprises a fixing apparatus and the coil is located in the fixing apparatus.

18. An image forming apparatus, comprising:

a fixing unit;

coil to heat the fixing unit; and a control apparatus to control electric power supplied to the coil, the control apparatus comprising:

an input current detection unit that detects an input current of the coil;

a resonant current detection unit that detects a resonant current of the coil;

a computing unit that calculates a difference between the detected resonant current and the detected input current, and an electric power control unit that controls the electric power supplied to the coil based on the calculated difference.

* * * * *

UNITED STATES PATENT AND TRADEMARK OFFICE

CERTIFICATE OF CORRECTION

PATENT NO. : 8,340,538 B2
APPLICATION NO. : 12/656533
DATED : December 25, 2012
INVENTOR(S) : An-sik Jeong It is certified that error appears in the above-identified patent and that said Letters Patent is hereby corrected as shown below:

Title Page, item (54), and in the specifications, Column 1, Line 2, Title: Delete "ELECTRONIC" and insert -- ELECTRIC --, therefor.

Signed and Sealed this
Twenty-eighth Day of May, 2013

Teresa Stanek Rea
*Acting Director of the United States Patent and Trademark Office*